US005900191A

United States Patent [19]

Gray et al.

[11] Patent Number: 5,900,191

[45] Date of Patent: May 4, 1999

[54] FOAM PRODUCING APPARATUS AND METHOD

[75] Inventors: Paul T. Gray; David R. Masters, both of Laguna Hills, Calif.

[73] Assignee: Stable Air, Inc., Laguna Hills, Calif.

[21] Appl. No.: 08/782,409

[22] Filed: Jan. 14, 1997

[51] Int. Cl.[6] ..... B01F 3/04

[52] U.S. Cl. ..... 261/59; 261/78.2; 261/DIG. 26

[58] Field of Search ..... 261/DIG. 26, 78.2, 261/DIG. 39, 59, 18.1

[56] References Cited

U.S. PATENT DOCUMENTS

| | | | |
|---|---|---|---|
| 2,003,184 | 5/1935 | Friedrich | 261/DIG. 26 |
| 2,171,932 | 9/1939 | Holmboe et al. | 261/78.2 |
| 2,271,671 | 2/1942 | Wible | 261/DIG. 72 |
| 2,432,971 | 12/1947 | Ruthman et al. | 106/674 |
| 2,549,507 | 4/1951 | Morgan et al. | 166/293 |
| 2,600,018 | 6/1952 | Nelson et al. | 106/730 |
| 2,629,667 | 2/1953 | Kaveler | 106/720 |
| 2,700,615 | 1/1955 | Heijmer | 106/197.01 |
| 2,797,904 | 7/1957 | Voorheis | 261/78.2 |
| 2,820,713 | 1/1958 | Wagner | 106/642 |
| 2,864,714 | 12/1958 | Dixon, Jr. et al. | 261/DIG. 26 |
| 2,959,489 | 11/1960 | Wagner | 106/727 |
| 3,030,258 | 4/1962 | Wagner | 156/71 |
| 3,169,877 | 2/1965 | Bartoli et al. | 106/730 |
| 3,215,549 | 11/1965 | Erickson | 106/694 |
| 3,233,660 | 2/1966 | Nettel et al. | 261/DIG. 72 |
| 3,287,001 | 11/1966 | Harris | 261/78.2 |
| 3,424,439 | 1/1969 | Baker | 366/101 |
| 3,430,865 | 3/1969 | McDougall | 239/427.5 |
| 3,751,755 | 8/1973 | Smith | 261/DIG. 26 |
| 3,758,319 | 9/1973 | Ergene | 523/218 |
| 3,967,815 | 7/1976 | Backus et al. | 366/64 |
| 4,039,170 | 8/1977 | Cornwell et al. | 366/19 |
| 4,068,625 | 1/1978 | Brown | 261/704 |
| 4,074,363 | 2/1978 | Croft | 366/138 |
| 4,185,923 | 1/1980 | Bouette et al. | 366/10 |
| 4,199,547 | 4/1980 | Levinsky et al. | 422/133 |
| 4,213,936 | 7/1980 | Ladrick | 261/DIG. 26 |
| 4,275,033 | 6/1981 | Schulte et al. | 422/133 |
| 4,328,178 | 5/1982 | Kossatz | 366/2 X |
| 4,372,352 | 2/1983 | Coppola et al. | 366/2 X |
| 4,394,289 | 7/1983 | Brown et al. | 261/DIG. 26 |
| 4,448,536 | 5/1984 | Strong | 366/66 |
| 4,549,676 | 10/1985 | Gerich | 222/145 |
| 4,599,208 | 7/1986 | Blaak | 261/83 |
| 4,705,405 | 11/1987 | Williams | 366/160 |
| 4,789,244 | 12/1988 | Dunton et al. | 366/12 |
| 4,895,683 | 1/1990 | Iwasaki | 261/104 |
| 4,915,300 | 4/1990 | Ryan | 239/9 |
| 5,113,945 | 5/1992 | Cable | 261/DIG. 26 |
| 5,339,991 | 8/1994 | Synder | 222/136 |

FOREIGN PATENT DOCUMENTS

WO 89/00153 1/1989 WIPO .

OTHER PUBLICATIONS

"Using Preformed Foam as a Concrete Admixture", Paul Gray, *Concrete Construction*, Dec. 1987, p. 1045.

*Primary Examiner*—Richard L. Chiesa

*Attorney, Agent, or Firm*—Brown, Martin, Haller & McClain, LLP

[57] ABSTRACT

A foam producing apparatus has a first mixing chamber with an inner subchamber connected to a supply of gas at a first pressure and an outer subchamber connected to a supply of a foamable liquid at a second pressure higher than the first pressure. A plurality of orifices connect the outer subchamber to the inner subchamber. The foamable liquid is forced from the outer subchamber into the inner subchamber through the orifices and is atomized to form droplets carried by the gas to an outlet. A second mixing chamber is connected to the outlet of the first mixing chamber and is filled with an agitating medium so that droplets propelled through the second mixing chamber are violently agitated to produce the desired foam.

16 Claims, 2 Drawing Sheets

FOAM PRODUCING APPARATUS AND METHOD

BACKGROUND OF THE INVENTION

The present invention relates generally to a foam producing apparatus and method, and is particularly concerned with such an apparatus usable for entraining air bubbles in concrete to produce various types of lightweight concrete structures having a high density of air voids, such as concrete wall panels.

It has been known for some time that lighter weight concrete structures can be made by entraining air bubbles in the concrete mixture at some point prior to placing the concrete, so that the concrete hardens to leave air voids throughout the structure. This type of lightweight concrete is generally known in the field as cellular concrete. Cellular or foamed concrete may be made by pre-forming a foam and then adding the foam to a slurry of cement, aggregate and water in a mixing device. Another known technique is to add a gas-forming agent to the slurry, causing the mix to swell as gas bubbles are formed. The reduced density of cellular concrete, and thus the reduced weight, reduces transportation and handling costs, and also reduces dead load imposed on a structure constructed from such concrete. It also has better heat insulation, freeze and thaw resistance, reduced water permeability and sound absorption properties than conventional concrete.

One foam generating device for producing a foam suitable for injection into a concrete slurry is described in U.S. Pat. No. 4,789,244 of Dunton et al. However, this and other known foam generating devices have been found to be subject to several disadvantages when attempting to entrain air bubbles into concrete mixtures. If the foam is injected into concrete in a concrete mixer, the bubbles will often have insufficient strength to withstand mixing for several hours during transportation to a construction site. If the bubbles break, water contained in the bubbles will mix in with the concrete, altering the concrete consistency and producing undesirable mix properties, such as high slump. Additionally, the known foam generating devices typically produce foams which contain too much water. Thus, the prior art foams, when mixed with concrete, produce bubbles which break too easily, either during mixing or working of the concrete as it is transported, or during placing and finishing of the concrete. Thus, previous attempts to produce lighter weight concrete structures have been unsuccessful or have produced concrete with a relatively low air void concentration, and which tends to be too wet and have too high a slump.

One prior art machine included an atomization chamber having a through flow of pressurized air and plural inlets for a mixture of water and foaming agent under pressure, and a mixing chamber connected to the outlet of the atomization chamber, the mixing chamber being filled with steel wool which acts as an agitating medium. This produces a foam which may be mixed with concrete, but still is subject to some of the disadvantages outlined above.

Thus, up to now, it has not been possible to produce a foam which is sufficiently stable to withstand the effects of mixing of concrete for extended periods of several hours or more during transportation and subsequent agitation of the concrete as it is placed and finished, without collapse of a substantial portion of the bubbles mixed with the concrete.

SUMMARY OF THE INVENTION

It is an object of the present invention to provide a new and improved method and apparatus for generating a foam which is more stable and can be mixed with concrete for extended periods of time without substantial amounts of bubbles collapsing.

It is a further object of the present invention to provide new and improved concrete panels with air voids made using the apparatus and method of this invention.

According to one aspect of the present invention, a foam producing apparatus is provided which comprises a first mixing chamber having a first inlet for connection to a supply of gas at a first pressure in a predetermined first pressure range, a second inlet for connection to a supply of a foamable liquid at a second pressure in a predetermined second pressure range, and an outlet, the first mixing chamber being subdivided by an internal wall into first and second separate subchambers connected to the first and second inlets, respectively, and the internal wall having a plurality of orifices connecting the first subchamber to the second subchamber. The first pressure is greater than the second pressure by a predetermined amount such that the foamable liquid is forced from the second subchamber into the first subchamber through the orifices and is thereby atomized to form droplets carried by the gas to an outlet end of the first subchamber. A second mixing chamber has an inlet at a first end connected to the outlet of the first mixing chamber and an outlet at a second end, and is filled with an agitating medium. The droplets are propelled through the second mixing chamber by the pressurized gas, and are violently agitated by the agitating medium to produce a foam at the second mixing chamber outlet.

Preferably, the agitating medium comprises a plurality of tubular members or eyelets each having a through bore, and the tubular members are preferably of several different sizes. The eyelets are packed into the second mixing chamber, and act to force the foam bubbles through various different size tubular segments in different directions, causing extreme changes in direction, compression, expansion, and violent agitation. As a result, a long-lasting foam is produced which is made up of a plurality of fine bubbles each having a skin with a high surface tension.

In a preferred embodiment of the invention, the first mixing chamber comprises an outer tube and an inner tube of smaller diameter than the outer tube which extends coaxially within the outer tube. The inner tube defines the first subchamber while the outer tube defines the second subchamber, and a plurality of orifices are provided along the inner tube. With this arrangement, the foamable liquid is supplied to the annular space surrounding the inner tube and is forced through the multiple openings to spray into the inner tube, forming a fine spray of droplets which is carried along the tube by the air or gas flow. Alternately, the fluid could pass through the inner tube, spraying into the compressed gas flowing in the outer plenum.

Preferably, the foamable liquid comprises a mixture of water and a foaming agent in predetermined proportions, and the pressurized gas is air. However, other inert gases may alternatively be used. A tube or hose is preferably connected to the outlet of the mixing chamber for transporting foam into a material such as concrete which is to be foamed.

Although the foam generating apparatus is particularly intended for use in mixing foam into concrete to produce air voids in a subsequently hardened concrete structure, it also has other potential applications such as in producing a fire extinguishing foam, or for mixing with sealant materials to apply a sealing cover to confine hazardous materials such as asbestos, for example. The foam may also be mixed with paste-like materials which are to be sprayed through spray guns, such as paint and the like, in order to produce improved flowability in such materials. The foaming agent selected will be dependent on the desired use of the foam.

According to another aspect of the present invention, a method of producing a foam is provided, which comprises the steps of supplying gas at a first pressure to an inlet end of an atomization chamber so that the gas flows through the chamber to an opposite, outlet end of the chamber, forcing a foamable liquid through a plurality of venturi openings into the atomization chamber so that the liquid is atomized to form droplets and the droplets are carried by the flow of gas to the outlet end of the chamber, conveying the droplets into a mixing chamber connected to the outlet end of the atomization chamber, and violently agitating the droplets in the mixing chamber by means of an agitating medium filling the mixing chamber to form a dense foam at an outlet end of the mixing chamber.

The foamable liquid is preferably a mixture of a foaming agent and water at a predetermined pressure which is higher than the gas pressure. The pressures of the gas and the foamable liquid combined with their volumetric flow rates will determine the amount of water which is entrapped in the bubbles as the foam is created, and thus the density of the resultant foam. By varying the ratio of gas and liquid pressures, the amount of trapped water in the foam may be increased or decreased. This is desirable since too much trapped water will make the concrete too wet.

According to another aspect of the present invention, a lightweight concrete wall panel is pre-cast using a foamed concrete mixture made with the apparatus described above. The panel has a central panel portion and side flanges forming a channel-shaped structure, and the concrete having air voids or spaces making up a percentage in the range from 20% to 40% of the total panel volume. With this panel, the panel thickness can be reduced significantly over conventional concrete wall panels while providing equivalent fire resistance. Under U.S. building codes, building walls must be capable of insulating against fire for up to four hours. With conventional concrete wall panels, this requires a wall thickness of over 7", making the walls very thick and heavy, and thus more susceptible to seismic forces and more costly for the concrete materials and the structural components required to support these massive walls. Up to now, it has not been possible to make an effective lightweight concrete wall panel and thus reduce the wall thickness. With the method and apparatus of this invention, sufficient bubbles can be entrained in liquid concrete during mixing and will be strong enough to withstand collapse so that the hardened concrete can be designed with up to 40% air voids. Preferably, the panels are made with an air void percentage in the range from 20% to 40%. This permits a panel thickness of 4" or less, while still meeting fire code regulations and providing better insulation than was previously possible, due to the insulating properties of the air entrained in the concrete.

Another advantage in lightweight, air-entrained concrete wall panels made according to the method and apparatus of this invention is the reduced sensitivity to seismic forces. Conventional tilt-up concrete panel buildings have massive, thick bearing walls which are sensitive to seismic forces due to their weight. Because of this, massive reinforcing connections must be made between panels, and between each panel and the floor and ceiling of the building. This significantly increases the cost of such buildings. The Uniform Building Code (1997) requires a design seismic force level of 30% of the weight of the wall, which for a conventional concrete wall panel of 95 lb./sq. ft. is a seismic load of 28.5 lb./sq. ft. In contrast, the lightweight concrete wall panels made according to this method and apparatus so as to have a large percentage of air voids, significantly reducing weight and thus reducing sensitivity to seismic forces. These panels will contribute only 12.0 lb./sq. ft. seismic force to the wall, providing better performance and reduced reinforcement requirements.

The foam generating apparatus and method of this invention produces a thick, long-lasting foam of durable bubbles which can be used for various purposes, most notably for mixing with concrete prior to laying of the concrete to form structures such as wall panels, sidewalks, benches, and the like which are of a much lighter weight than was previously possible. The bubbles produces are small and have a high enough surface tension to withstand collapse even when mixed with liquid concrete in a concrete mixer over extended periods of time.

BRIEF DESCRIPTION OF THE DRAWINGS

The present invention will be better understood from the following detailed description of a preferred embodiment of the invention, taken in conjunction with the accompanying drawings, in which like reference numerals refer to like parts, and in which.

DESCRIPTION OF THE PREFERRED EMBODIMENT

Figure 5:
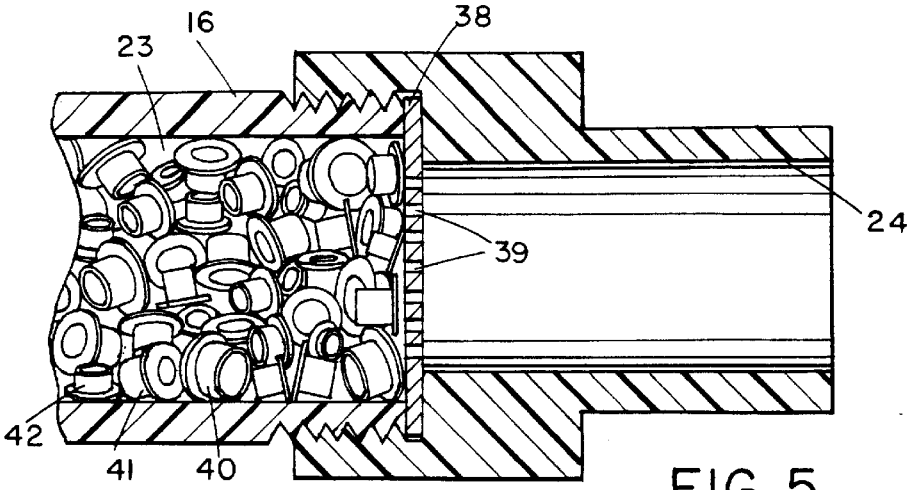
FIG. 5 is an enlarged sectional view taken on line 5—5 of FIG. 2.
Figure 6:
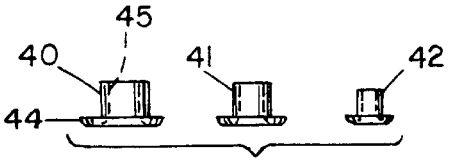
FIG. 6 illustrates the range of sizes of eyelets used in the unit.
Figure 7:
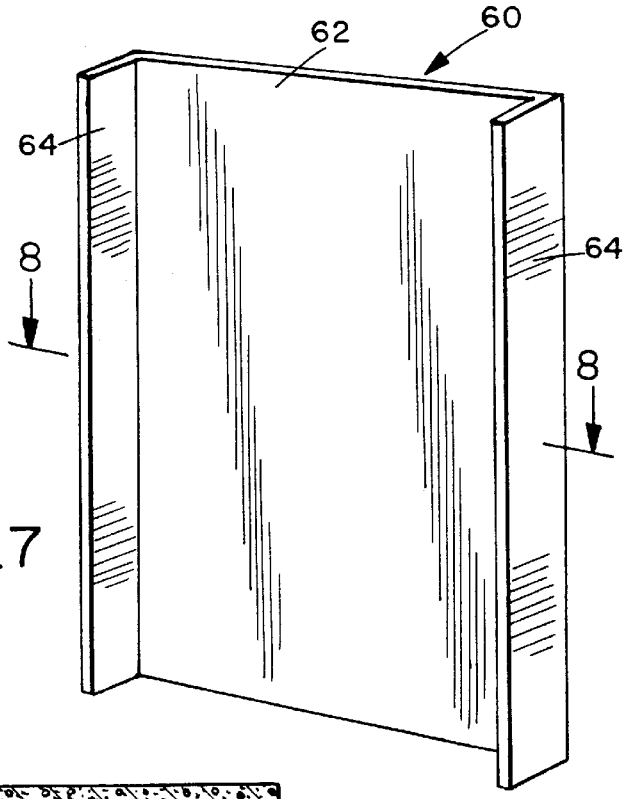
FIG. 7 illustrates a concrete panel made using concrete with entrained air bubbles using the apparatus of FIG. 2.
Figure 8:
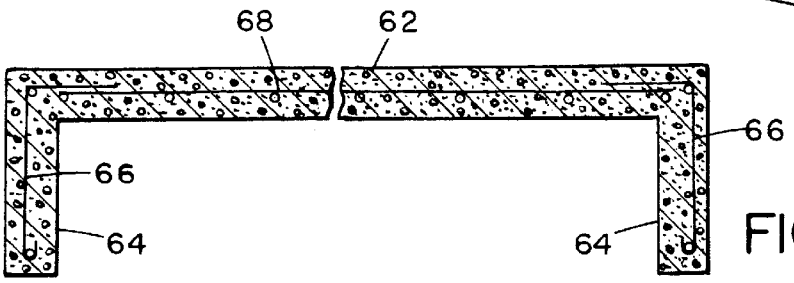
FIG. 8 is an enlarged sectional view taken on line 8—8 of FIG. 7.

FIGS. 1–6 illustrate an apparatus for producing foam according to a preferred embodiment of the present invention, while FIGS. 7 and 8 illustrate one possible product made using the foam produced by the apparatus. The main purpose of this apparatus is to produce a foam suitable for mixing with liquid concrete material prior to placing from a concrete mixer, such that the subsequently hardened concrete will have entrained air voids. However, the foam generating apparatus may also be advantageously used for making foams for other purposes, such as fire extinguishing foams, mixing with pasty or high viscosity materials, such as paint, to make them more flowable for application through spray guns, and mixing with sealant materials to act as a carrying agent for such material, for example.

Figure 2:
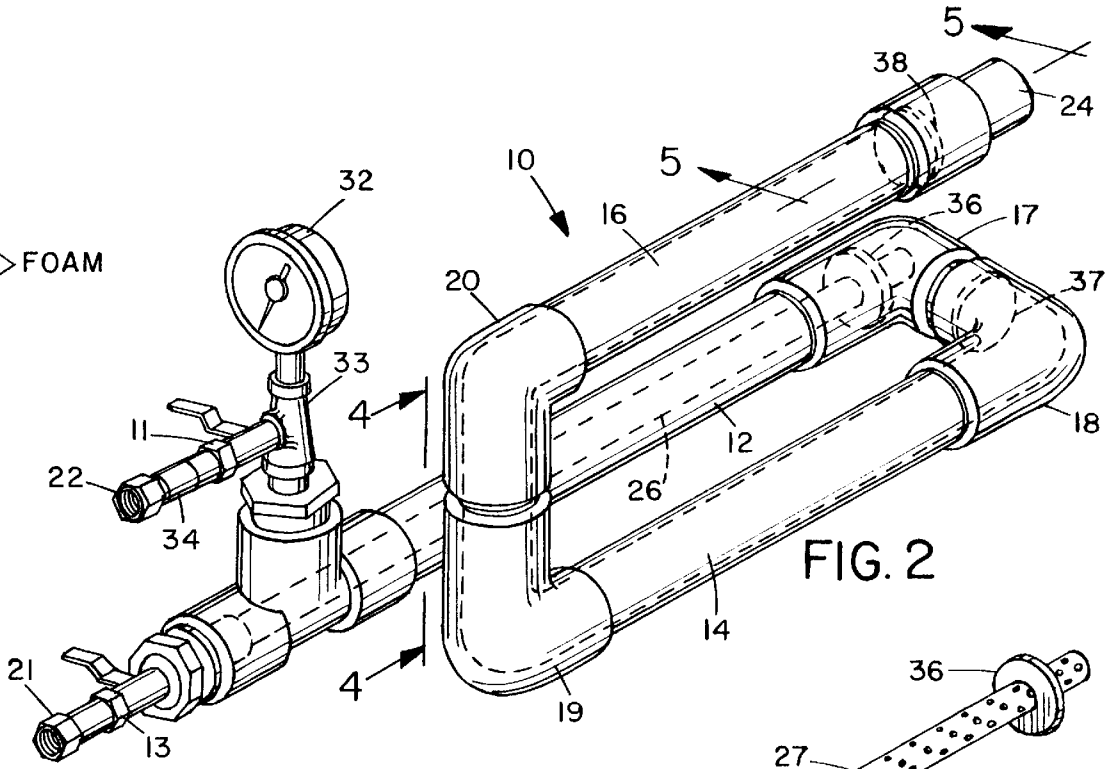
FIG. 2 is a pictorial view of the foam generating unit of FIG. 1.

As best illustrated in FIG. 2, the foam generating apparatus 10 comprises an elongate tubular structure having a series of three straight tubular portions or pipes 12,14,16 connected together by two pairs of direction-reversing bends or elbow fittings 17,18 and 19,20, respectively. The first straight portion 12 comprises an atomization unit with a first inlet 21 at one axial end for a gas under pressure and a second, transverse inlet 22 for receiving a mixture of water and a foaming agent. The inlets are suitably quick disconnect hose couplings, and are connected to the atomization unit via ball valves 11,13. The other tubular portions 14,16 and the connecting bends 18,19 and 20 together form a mixing chamber 23. The mixing chamber has an outlet 24 at its free end for connection to a suitable hose or tube for dispensing foam.

The pipes and fittings forming the tubular structure of the apparatus were of schedule 80 P.V.C. in a preferred embodiment of the invention, although they may alternatively be fabricated in other materials such as brass, steel, or other suitable plastics materials or the like.

Figure 3:
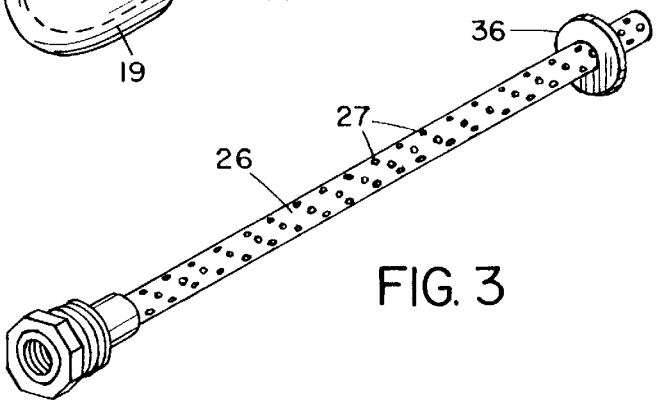
FIG. 3 is a pictorial view of the foam and air mixing tube.
Figure 4:
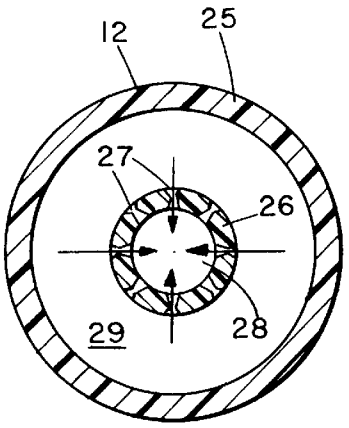
FIG. 4 is an enlarged sectional view taken on line 4—4 of FIG. 2.

The atomization unit is illustrated in more detail in FIGS. 3 and 4, and comprises an outer tube 25 and an inner tube 26 extending coaxially along the length of the outer tube up to the first elbow 17, as illustrated in dotted outline in FIG. 2. Inlet 21 is connected to the first end of the inner tube 26, as illustrated in FIG. 3, and the tube 26 has a series of openings 27 extending along its length which connect inner chamber 28 extending along the inside of tube 26 to the outer annular chamber 29 surrounding the tube. The second inlet 22 is connected to the outer chamber 29. As best illustrated in FIG. 4, the openings 27 are venturi passages. However, straight sided orifices may be used in other embodiments.

Figure 1:
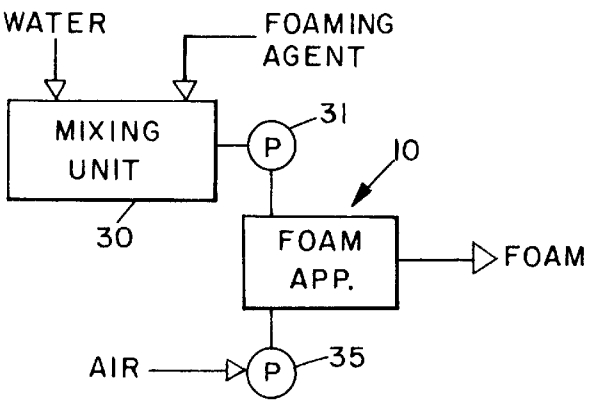
FIG. 1 is a schematic block diagram of the foaming apparatus according to a preferred embodiment of the invention.

As schematically illustrated in FIG. 1, the water and foaming agent are mixed together in a mixing unit 30, and then pumped via pump 31 at a predetermined pressure to inlet 22. A non-vibrating pressure gauge 32 is connected to inlet 22 via a T-joint 33 so that the pressure can be monitored. A filter 34 is also provided at inlet 22 to filter any particles from the water. Water supplies at building sites are often not particularly pure and may include dirt, sand and other particles. Thus, filter 34 is designed to filter out such particles from the water. A normally closed, air-actuated shut-off valve is preferably provided in the air supply line, in order to prevent water flow and surfactant wastage when the apparatus is turned off. Optionally, a gate valve may be provided in the air supply line to direct air through a hose coupling to the inlet water hose coupling. This can be used for air flushing the unit for protection against freezing when used in a cold climate.

The mixing unit could be simply a tank filled with foaming agent to a predetermined level, with a hose supplying water to the bottom of the tank at an angle so as to produce a swirling effect. This has been found to produce thorough mixing between the water and foaming agent. A suitable gas such as air is pumped via pump 35 to inlet 16. Alternately, a jet pump could inject the foaming solution into the water flow or a separate injection pump could inject a metered amount of foaming agent into the main water flow.

An annular sealing washer or plug 36 is mounted adjacent the innermost end of the inner tube 26 so as to seal the outer chamber 29, so that the mixture of water and foaming agent under pressure is forced through openings 27 into the inner chamber 28, as indicated by the arrows in FIG. 4. This causes the mixture to atomize into small droplets which are carried along by the air flowing through chamber 28 to the opposite, open end of tube 26 at elbow 17.

The mixing chamber 23 is closed at each end by a sealing disc or retainer 37,38, respectively. Discs 37,38 may be identical and each have a series of small openings 39, as best illustrated in FIG. 5. The chamber is filled with a suitable agitating medium, and in the preferred embodiment the agitating medium comprises a plurality of eyelets or tubular members 40,41,42 in three or more different sizes. FIG. 6 illustrates three of the eyelets 40,41,42 of gradually reducing size. In one embodiment, the chamber 28 extending through elbow 18, straight pipe or tube 14, elbows 19,20, and straight tube 16 was packed with brass eyelets in mixed sizes from 1 to 5.

As best illustrated in FIG. 6, each eyelet is a sharp-edged tubular section with an annular rim 44 at one end, and has a through bore or passage 45. The eyelets may be of brass or other materials, and more than three different size eyelets may be used to fill chamber 23 if desired.

In one example of the apparatus of FIGS. 1–6, the straight pipe sections were each of 2" diameter pipe, while the inner pipe or tube 26 was of ¾" diameter. Inner tube 26 was fabricated in two halves, with the venturi holes drilled prior to reassembling and bonding the two pipe halves together. Alternatively the venturi orifices can be separately fabricated as inserts and installed into the pipe. The length of the first pipe section and inner tube was of the order of 14".

The air is supplied to inlet 21 at a pressure in the range from 100 p.s.i. plus or minus 10 p.s.i., while the water/foaming agent mixture is preferably pressurized to a pressure of 175 p.s.i. plus or minus 25 p.s.i. By varying the geometry or quantity of the water, jet orifices of the mixing tube or the geometry or medium of the mixing chamber, pressures and pressure relationships may vary significantly. The geometry, orifice size, and pressure relationships must be such that the foam solution is atomized into tiny droplets, to ensure formation of very fine bubbles in the foam. Because of the pressure differential, the aqueous foaming agent will be forced inwardly through the venturi openings 27, and will be atomized into droplets or a fine spray due to passage through the orifices or venturis. The atomized droplets are propelled by the pressurized air along the tube 26 and through the openings in end plate or retainer 37 into the mixing chamber.

In the mixing chamber 23, the droplets are forced through the multiple randomly oriented tubular openings in eyelets 40,41 and 42 with severe changes in direction, compression, expansion and violent agitation. This causes a foam to be produced which comprises fine bubbles each containing water. The density of the foam, i.e. the amount of water in a unit quantity of foam, can be varied by changing the pressures at inlets 21 and 22. This allows the foam density to be varied in the range from 6–11 oz. per gallon of foam, or 45–80 gm of water per liter of foam. Generally, lower inlet pressures produce a foam with a higher density of water, so that an air inlet pressure of 90 p.s.i. and a foamable liquid inlet pressure of 150 p.s.i. produce a foam of around 80 gm. water per liter, while an air inlet pressure of 110 p.s.i. and a foamable liquid inlet pressure of 175 p.s.i. produces a foam of around 45 gm. of water per liter. By varying the geometry, quantity of water, jet orifices of the mixing tube, or the geometry of medium of the mixing chamber, pressures and pressure relationships may vary significantly.

As discussed above, one possible advantageous use for the foam produced by this apparatus is mixing with liquid concrete to produce a foamed concrete material which can be pre-cast in a mold or cast on site, to produce air-entrained, lightweight concrete on drying. Where the foam is to be mixed with concrete, suitable foaming agents for mixing with water to produce the foam in apparatus 10 are Mearl Foam, made by Mearl Corporation of Roselle Park, N.J., Cellufoam, made by Cellufoam Corp of Ontario, Canada, Elastizell, made by Elastizell Corp. of America, Ann Arbor, Mich., Cellucon, made by Romaroda Chemicals Pty. Ltd. of Victoria, Australia, Lite-Crete, made by Lite-Crete, Inc. of Fresno, Calif., and similar surfactants or foaming agents used in the foaming of concrete. The use of such foaming agents with the pressure differentials described above and the apparatus of FIGS. 2–6 has been found to produce a thick; creamy foam of fine bubbles which are extremely resistant to collapse and are long-lasting, even when mixed with concrete for extended intervals of several hours. Since the bubbles are retained within the concrete material for longer periods of time without collapsing, they will still be present when the concrete is cast or placed. As the concrete hardens, the heat of concrete curing will collapse the bubbles, releasing the trapped water which the concrete will use in order to fully hydrate. Thus, there is less need to wet the concrete during curing, as is normally necessary with conventional, unfoamed concrete.

FIGS. 7 and 8 of the drawings illustrate a pre-cast concrete wall panel 60 made from a slurry of cement, aggregate and water mixed with predetermined quantities of foam produced by the apparatus of FIGS. 1–6. The amount of foam mixed with the slurry is sufficient to produce an air void density in the range from 20% to 40% of the total panel volume. The panel 60 has a central flat panel portion 62 and perpendicular side flanges 64, forming a channel-like structure. Reinforcing rebars 66 and mesh 68 are embedded in the concrete panel in a conventional manner, as best illustrated in FIG. 8. However, unlike conventional concrete wall panels, which must be over 7" thick to meet fire code insulation requirements, the central portion 62 of the panel has a thickness of only 4", since the air voids in the panel will provide increased insulation and allow the panel thickness to be reduced.

Due to the improved properties of the foam produced by the apparatus of FIGS. 1–6, which will be a dense, creamy foam of small bubbles having a relatively high surface tension, the bubbles will be strong enough to resist collapse during mixing with the slurry and injecting the foamed mixture into the mold. As the concrete hardens, the bubbles will burst, leaving some water which will be used for hydration during curing. This foam is capable of effectively producing air-entrained concrete with consistent air voids spread throughout the volume of the concrete structure, while previous foams used for such purposes would tend to collapse too soon and not produce an optimum air void density.

Due to the reduced weight of the concrete panel 60 with 20% to 40% air voids, as compared with a conventional concrete panel, the lower mass panel is subject to reduced seismic forces and therefore does not require as much reinforcement against such forces. A conventional concrete panel without air voids must be over 7" thick in order to meet fire code requirements and typically has a weight of around 95 lbs./sq. ft. Because of the weight of the massive wall produced with such panels, massive reinforcement structures are required to connect the panels together and to floor and ceiling structures, to reduce the risk of collapse in the event of an earthquake. In contrast, the concrete panel with air voids made using the apparatus of this invention only needs to be 4" thick in order to meet U.S. fire code requirements, and may be designed to have a weight of less than 100 lb./cu. ft. Thus, there is a major reduction in panel weight with this invention, and the reduced weight makes the panel much less sensitive to seismic forces, such that extra reinforcement is radically reduced. Construction costs using concrete panels can therefore be reduced considerably using air-entrained concrete panels manufactured using foam made by the apparatus of this invention.

The foam generating apparatus and method of this invention produces a foam which is dense and creamy, and is of the consistency of a shaving cream foam from an aerosol can. The foam consists of small or fine bubbles each containing a small amount of water, and is suitable for many applications, but is particularly advantageous for mixing with a concrete slurry in order to make an air-entrained concrete. The bubbles have a high surface tension and do not tend to coalesce or break, even during long mixing periods. Various materials may be added to the concrete mix without depleting the foam, such as fine sand, plasticizer, accelerator, rock dust and the like. Typically, around 2–11 cu. ft. of foam will be added to each cubic yard of concrete, with the amount depending on the desired air void density in the finished structure. A concrete mix made with the foam will be very workable and easy to finish. When the foam is added to the concrete slurry, the amount of water mixed in with the slurry is reduced, since the bubbles will release some water as they break during curing of the concrete. The concrete produced will have less cracks, and will have low thermal conductivity, strength of 400 p.s.i. to 7,450 p.s.i., and high fire resistance.

Although a preferred embodiment of the invention has been described above by way of example only, it will be understood by those skilled in the field that modifications may be made to the disclosed embodiment without departing from the scope of the present invention, which is defined by the appended claims.

We claim:

1. A foam producing apparatus, comprising:

a first mixing chamber having a first inlet for connection to a supply of gas at a first pressure in a predetermined first pressure range, a second inlet for connection to a supply of a foamable liquid at a second pressure in a predetermined second pressure range, and an outlet;

the first mixing chamber having an inner subchamber and an outer subchamber, and a plurality of orifices connecting the outer subchamber to the inner subchamber, the inner subchamber having an inlet end and an outlet end;

the first inlet being connected to the inlet end of the inner subchamber and the outlet being provided at the outlet end of the inner subchamber, and the second inlet being connected to the outer subchamber;

the first pressure being less than the second pressure by a predetermined amount such that the foamable liquid is forced from the outer subchamber into the inner subchamber through the orifices and is atomized to form droplets carried by said gas to the outlet end of the inner subchamber;

a second mixing chamber having an inlet at a first end connected to the outlet of the first mixing chamber and an outlet at a second end; and an agitating medium filling said second mixing chamber, whereby droplets propelled through said second mixing chamber are violently agitated to produce a foam at said second mixing chamber outlet.

2. The apparatus as claimed in claim 1, wherein the agitating medium comprises a plurality of randomly oriented eyelets.

3. The apparatus as claimed in claim 2, wherein each eyelet comprises a sharp-edged tubular segment with a through bore.

4. The apparatus as claimed in claim 2, wherein the eyelets are of at least three different sizes.

5. The apparatus as claimed in claim 2, wherein each eyelet has a cylindrical portion with an enlarged annular flange at one end.

6. The apparatus as claimed in claim 1, wherein the first mixing chamber comprises an outer pipe and an inner pipe extending coaxially within the outer pipe, the inner pipe defining said inner chamber and the outer chamber comprising a region between the inner pipe and outer pipe.

7. The apparatus as claimed in claim 6, wherein said inner and outer pipes are of PVC material.

8. The apparatus as claimed in claim 6, wherein the inner pipe has a plurality of spaced orifices extending along its length.

9. The apparatus as claimed in claim 1, wherein the first pressure is in the range from about 40 p.s.i. to about 110 p.s.i.

10. The apparatus as claimed in claim 9, wherein the second pressure is in the range from about 80 p.s.i. to about 200 p.s.i.

11. The apparatus as claimed in claim 1, wherein the first mixing chamber is elongate and has a longitudinal axis and the first inlet is coaxial with said longitudinal axis, whereby gas is directed to flow axially along said first mixing chamber from said inlet end to said outlet end, and the orifices are oriented radially inwardly into said first mixing chamber whereby said foamable liquid is directed radially inwardly into said first mixing chamber.

12. A foam producing apparatus, comprising:

a first mixing chamber having a first inlet for connection to a supply of gas at a first pressure in a predetermined first pressure range, an outlet, and a second inlet for connection to a supply of a foamable liquid at a second pressure in a predetermined second pressure range;

the first mixing chamber having an internal wall dividing said first mixing chamber into an inner subchamber and an outer subchamber, the wall having a plurality of openings connecting the outer subchamber to the inner subchamber, the inner subchamber having an inlet end and an outlet end;

the first inlet being connected to the inlet end of the inner subchamber and the outlet being provided at the outlet end of the inner subchamber, and the second inlet being connected to the outer subchamber;

the first pressure being less than the second pressure by a predetermined amount;

a second mixing chamber having an inlet at a first end connected to the outlet of the first mixing chamber and an outlet at a second end; and an agitating medium filling said second mixing chamber.

13. A method of generating a foam, comprising the steps of:

supplying gas at a first pressure to an inlet end of a first, inner subchamber;

supplying a foamable liquid at a second pressure higher than said first pressure to an inlet of a second, outer subchamber surrounding said first subchamber;

forcing said foamable liquid through a plurality of connecting passages connecting said second, outer subchamber to said first, inner subchamber whereby said liquid is atomized to form droplets;

conveying said droplets through said inner subchamber to an outlet end of said inner subchamber connected to an inlet end of a mixing chamber; and violently agitating said droplets in said mixing chamber by means of an agitating medium filling said mixing chamber to form a dense foam at an outlet end of said mixing chamber.

14. The method as claimed in claim 13, wherein the step of violently agitating said droplets comprises forcing them through a series of tubular bores in a plurality of randomly oriented eyelets filling said mixing chamber.

15. The method as claimed in claim 13, wherein the step of forcing said foamable liquid through said connecting passages comprises compressing and expanding said liquid through a venturi-shaped configuration in each connecting passage.

16. The method as claimed in claim 13, wherein the step of supplying gas comprises supplying gas to the first end of an elongate subchamber having a longitudinal axis such that the gas flows in an axial direction along said subchamber from said inlet end to said outlet end, and the foamable liquid is forced in a radial direction inwardly into said elongate subchamber and transverse to the gas flow direction.

* * * * *